United States Patent [19]

Shank

[11] 4,022,545

[45] May 10, 1977

[54] ROOTED AERODYNAMIC BLADE AND ELASTIC ROLL PIN DAMPER CONSTRUCTION

[75] Inventor: Wayne C. Shank, Tucson, Ariz.

[73] Assignee: Avco Corporation, Williamsport, Pa.

[22] Filed: Jan. 28, 1976

[21] Appl. No.: 653,145

Related U.S. Application Data

[63] Continuation-in-part of Ser. No. 504,889, Sept. 11, 1974, abandoned.

[52] U.S. Cl. ..... 416/221; 416/140; 416/135

[51] Int. Cl.[2] ..... F01D 5/10; F01D 5/32

[58] Field of Search ..... 416/219–221, 416/134–136, 140, 206, 500, 207, 241 B

[56] References Cited

UNITED STATES PATENTS

| | | | |
|---|---|---|---|
| 1,619,133 | 3/1927 | Kasley | 416/220 |
| 2,595,829 | 5/1952 | Dean | 416/221 |
| 2,686,655 | 8/1954 | Schorner | 416/220 |
| 2,727,716 | 12/1955 | Feilden et al. | 416/221 X |
| 2,753,149 | 7/1956 | Kurti | 416/220 X |
| 2,847,187 | 8/1958 | Murphy | 416/221 |
| 2,936,155 | 5/1960 | Howell et al. | 416/500 X |
| 2,997,274 | 8/1961 | Hanson | 416/500 X |
| 3,572,970 | 3/1971 | Smuland | 416/221 |
| 3,687,569 | 8/1972 | Klompas | 416/500 X |
| 3,720,481 | 3/1973 | Motta | 416/220 |

FOREIGN PATENTS OR APPLICATIONS

| | | | |
|---|---|---|---|
| 950,557 | 10/1956 | Germany | 416/220 |
| 632,001 | 7/1936 | Germany | 416/219 |
| 2,117,220 | 10/1971 | Germany | 416/241 B |
| 2,108,176 | 8/1972 | Germany | 416/241 B |
| 312,864 | 11/1933 | Italy | 416/220 |
| 753,229 | 7/1956 | United Kingdom | 416/220 |

*Primary Examiner*—Everette A. Powell, Jr.
*Attorney, Agent, or Firm*—Charles M. Hogan

[57] ABSTRACT

Herein disclosed is the combination of an aerodynamic blade having a root formed with outwardly curved shoulders and a transverse curved indentation, a rotor disc formed with a blade root receiving slot having curved complementary retaining surfaces in contact with those shoulders and an elastic split metallic roll pin disposed between the indentation and disc to provide damping, the radii of the curved shoulders and retaining surfaces being generated from an axis below said indentation.

2 Claims, 4 Drawing Figures

ROOTED AERODYNAMIC BLADE AND ELASTIC ROLL PIN DAMPER CONSTRUCTION

BACKGROUND OF THE INVENTION

This application is a continuation-in-part of my now abandoned application Ser. No. 504,889, entitled "Rooted Aerodynamic Blade and Elastic Retainer Construction," filed Sept. 11, 1974 and assigned to the same assignee as the present application and invention, to wit: Avco Corporation.

The present invention comprises a novel damped aerodynamic blade and elastic roll pin construction for use in dynamic rotating machinery, for example, axial flow compressors and turbines. In rotating machinery of this kind the attachment of the individually shaped blades to the rotor discs presents difficult mechanical design problems. These problems typically arise and are here considered in the general environment of axial flow compressors.

Going back into the history of turbine blade attachments one finds common types referred to as "fir-tree" and "dove-tail."

In some prior art structures a pin is passed through the blade root and the rotor disc to provide attachment. The pin-type structure of U.S. Pat. No. 3,400,912 to Carta and Stargardter, issued Sept. 10, 1968, features a variation of root dimensions, and/or the radial position of the pin, from blade to blade in order to lessen undesired effects of resonance.

An interesting construction of the dove-tail type is that of U.S. Pat. No. 1,619,133 to Kasley issued Mar. 1, 1927. In the Kasley construction the slots in the turbine disc are longitudinal and not transverse.

In the structure of U.S. Pat. No. 2,595,829 to Dean, issued May 6, 1952, the blade root portions are semicircular and positioned in conforming sockets. Under the root of each blade is a resilient cushion or dampening member which urges the convex blade root against the concave socket. The dampening member yields sufficiently to permit the blade to pivot slightly in the socket. The filler material is such that the Dean structure is a relatively low-speed device.

In the structure of U.S. Pat. No. 2,686,655, to Schorner, issued Aug. 17, 1954, the blades are ceramic and positively located by spacing pieces. A thermally balanced joint is shown.

Reference is now made to the U.S. Pat. No. 2,727,716 to Feilden et al, issued Dec. 20, 1955. In the structure there shown each blade is rendered tiltable by a flexible tension element serving as an anchor. Synthetic rubber damping elements are there featured. Arrangements of this type involve stress risers and are limited as to maximum speed.

The structure of U.S. Pat. No. 2,753,149 to Kurti, issued July 3, 1956, is of the fir-tree type with a retaining shank. The clearance around the shank is such as to permit tilting of the blade. This patent is primarily concerned with the axial locking of blades.

U.S. Pat. No. 2,847,187 to Murphy, issued Aug. 12, 1958, features a blade locking piece in resilient strip form. West German Patent No. 950,557, published Oct. 11, 1956, shows a pine-tree root structure similar to that of Kurti, featuring a boltlike retainer and complementary surfaces on blade and disc for permitting limited tilting. West German Patent No. 632,001, published July 1, 1936, shows an arrangement in which contact surfaces between blade and disc deform. Italian Patent No. 312,864, granted Nov. 28, 1933, features an arrangement in which a wedge is inserted between the base of the disc slot and the bottom of the blade.

The blade arrangement in U.S. Pat. No. 3,720,481 to Motta, issued Mar. 13, 1973, employs a split bushing to accomplish a secure locking of the blade root. The blade spacer of the U.S. Pat. No. 3,572,970 to Smuland, issued Mar. 30, 1971, performs a radial locking function and is made oversize for that purpose. In the structure of U.S. Pat. No. 2,936,155 to Howell et al, issued May 10, 1960, the split pin provides a rigid support for the blade.

The construction disclosed in the U.S. Pat. No. 2,997,274 to Hanson, issued Aug. 22, 1961, shows pins for damping purposes but the pins are either a duality or extended in a radial direction. The structure of British Pat. No. 753,229, complete specification published July 18, 1956, is directed to the seating of ceramic blades.

SUMMARY OF THE INVENTION

The principal object of the invention is to provide an improved compressor blade root and roll pin combination for a high-speed turbine, characterized as follows:

1. Root-receiving slots having arcuate shoulders radially generated about an axis geometrically located beyond the root of the blade;

2. Complementary curved formations on the blade root to permit swinging movement of the blade; and

3. Placement of an expanding spring pin under the blade root to damp the swinging oscillations of the blade and to assure shoulder contact for the blade when operating at low speed.

A more general object is to provide an expanding spring-pin damper together with pin-receiving formations on the root of the blade and the rotor disc.

Another object of the invention is to provide a blade root spring-pin damper construction which not only withstands high centrifugal loads and aerodynamic forces and mechanical moments and stresses and reduces the stresses in the blade to a relatively low level, but also introduces a very high degree of damping, so that resonant vibrations are prevented from destroying the blades. This is accomplished by a construction which is uniformly applied to all of the blade roots on a given disc, without the necessity to vary blade parameters, from root to root or as between groups of roots, as suggested in U.S. Pat. No. 3,400,912.

BRIEF DESCRIPTION OF THE DRAWINGS

For a better understanding of the invention together with other and further objects, advantages and capabilities thereof, reference is made to the following description of the accompanying drawings in which.

DESCRIPTION OF THE PREFERRED EMBODIMENT OF THE INVENTION

Figure 3:
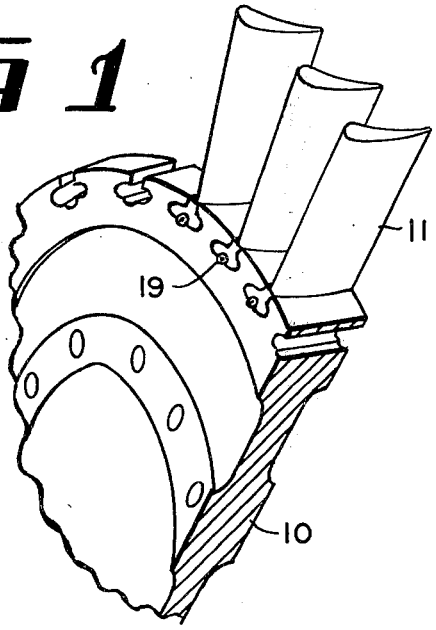
FIG. 3 is a fragmentary perspective view showing a plurality of blade root and damper constructions in accordance with the invention.

The detailed description is prefaced with some theoretical considerations relevant to the mechanical forces involved in aerodynamic turbine and compressor blades. The blades, as shown in FIGS. 3 and 4, are subjected to a plurality of forces and moments.

Figure 4:
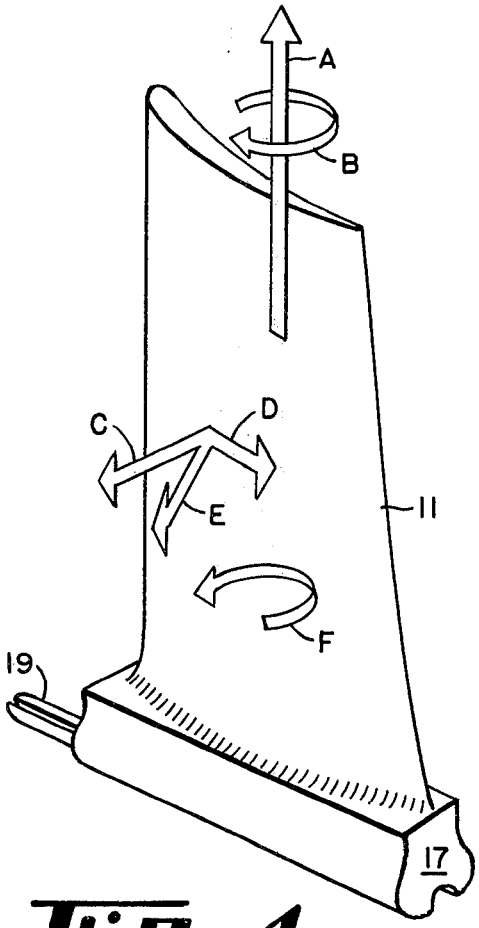
FIG. 4 is a perspective view of a typical aerodynamic blade and damper arrangement incorporated in the inventive combination herein disclosed.

The arrow A in FIG. 4 represents the very high centrifugal force which is incident to the rotation of the blade mass at a high speed. The twist of the blade reacts in such a manner as to create a high order pitch-reducing moment B. Two substantial aerodynamic forces also act on the blade. The lifting force C and the drag force D combine as components into the resultant force E. These forces normally act frontally of the neutral axis of the blade section and create a twisting moment F which is usually such as to be in the opposite rotational direction to the pitch-reducing moment B.

The centrifugal force A is effectively applied to the center of gravity of the blade. The centrifugal pitch-reducing moment B acts relative to the neutral axis of the blade section. The resultant E of the aerodynamic forces acts approximately as a moment about the neutral axis of the blade.

In addition to the aforementioned tensile and torsional and bending stresses in the blade, pulsating gas flow against the blade surfaces and mechanical excitations from the hub set up resonant vibrating modes of bending and torsion.

Figure 1:
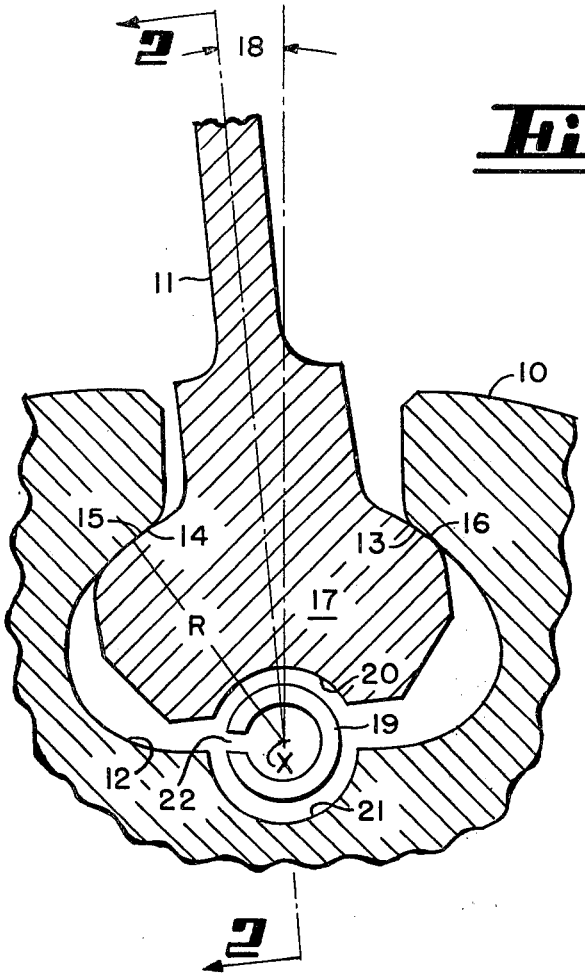
FIG. 1 is an end view of the combination of slotted rotor disc and elastic spring-pin damper and swingable blade root in accordance with the invention.
Figure 2:
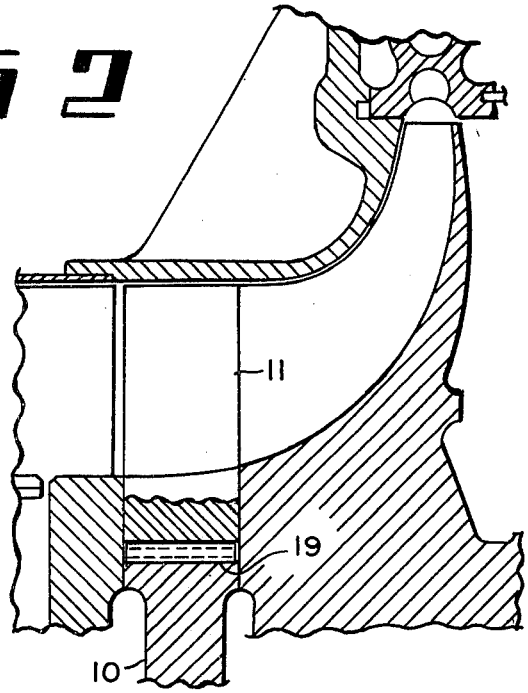
FIG. 2 shows the FIG. 1 construction as installed in a compressor and includes an elevational sectional view as taken along section line 2—2 of FIG. 1, looking in the direction of the arrows.

As stated above, the slotted disc and blade root and elastic damper construction in accordance with the invention reduces the stresses in the blade and introduces significant damping factors. Referring first to FIG. 3 of the drawings, there is shown a compressor rotor disc 10 on which are mounted rooted aerodynamic blades, such as 11. Blade 11 is typical and is elected for further description. The various forces pertaining to blade 11 have been described in connection with FIG. 4. In FIG. 2 blade 11 is shown in a typical compressor stage environment. The details of the invention are best shown in FIG. 1. The construction of the undercut or slot 12 in disc 10 is such as to provide outwardly curved surfaces 13 and 14 at zones of contact with complementary inwardly curved surfaces 15 and 16 formed in the root 17 of blade 11. These curved surfaces are generated by swinging movement of a radius R about an axis located at point X. Note that point X is below the root 17 of blade 11. The surfaces 15 and 16 on root 17 and the surfaces 13 and 14 on disc 10 are complementary so that the blade 11 may tilt in a tangential direction at a small angle 18, whereby the blade bending stresses arising from the aerodynamic resultant force E are eliminated by assuming a position departing from the true radial with respect to the disc. The blade therefore aligns with the resultant of that force E and the centrifugal force A.

Further in accordance with the invention, a metallic elastic rolled spring 19, split as indicated at 22, is inserted between opposed axially extending spring-receiving formations 20 and 21. Formation 20 is a transverse cut-out indentation below root 17. Formation 21 is an arcuate cut-out depression in slot 12. Elastic spring 19 is located at the axis of blade rotation, effectively supplies frictional damping and eliminates destructive vibratory stresses. At the same time the split spring 19 holds the blade 11 in contact at 13 and 14 with shoulders 15 and 16 during low-speed operation. Note that the damper 19 is disposed in symmetric relation to the hinged axis X.

While there has been disclosed and described a preferred embodiment of the invention, it will be apparent to those of skill in the art that various changes and modifications may be made therein without departing from the true scope of the invention as defined in the appended claims. Accordingly, it is intended in the claims to cover all such changes and modifications as fall within the proper scope of the invention.

Having disclosed my invention, I claim:

1. In rotating machinery, the combination of:

an aerodynamic blade having a root formed with outwardly curved shoulders and an axially extending lower curved indentation, a rotor disc formed with a transverse blade root receiving slot having curved retaining surfaces in contact with said shoulders, and an elastic split metallic roll pin disposed between said indentaion and disc to provide damping while permitting the blade to tilt, the axis of swinging movement of the blade being below its root and the curved shoulders and complementary retaining surfaces being generated by a radius having such axis as a center, the roll pin assuring contact at low speeds between said shoulders and said surfaces.

2. The combination in accordance with claim 1 in which the rotor disc is formed with a second indentation complementary to that formed in the root.

* * * * *